US009112282B2

(12) United States Patent
Nurnberger et al.

(10) Patent No.: US 9,112,282 B2
(45) Date of Patent: Aug. 18, 2015

(54) DEPLOYABLE SATELLITE REFLECTOR WITH A LOW PASSIVE INTERMODULATION DESIGN

(71) Applicant: The United States of America, as represented by the Secretary of the Navy, Washington, DC (US)

(72) Inventors: Michael W. Nurnberger, Springfield, VA (US); Christopher P. Amend, Arlington, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 341 days.

(21) Appl. No.: 13/735,769

(22) Filed: Jan. 7, 2013

(65) Prior Publication Data

US 2013/0141307 A1 Jun. 6, 2013

Related U.S. Application Data

(63) Continuation of application No. 13/528,810, filed on Jun. 20, 2012, now abandoned, which is a continuation-in-part of application No. 13/301,292, filed on Nov. 21, 2011, now abandoned, which is a continuation-in-part of application No. 13/102,848, filed on May 6, 2011, now abandoned.

(60) Provisional application No. 61/331,878, filed on May 6, 2010.

(51) Int. Cl.

| | |
|---|---|
| ***H01Q 15/16*** | (2006.01) |
| ***H01Q 1/28*** | (2006.01) |
| ***H01Q 19/13*** | (2006.01) |

(52) U.S. Cl.
CPC ..... *H01Q 15/16* (2013.01); *H01Q 1/288* (2013.01); *H01Q 15/161* (2013.01); *H01Q 19/134* (2013.01)

(58) Field of Classification Search
CPC ... H01Q 15/16; H01Q 19/134; H01Q 15/161; H01Q 1/288
See application file for complete search history.

(56) References Cited

U.S. PATENT DOCUMENTS

| | | | | |
|---|---|---|---|---|
| 3,587,098 | A * | 6/1971 | Gosnell | 343/915 |
| 4,249,184 | A * | 2/1981 | Vines | 343/840 |
| 4,635,071 | A * | 1/1987 | Gounder et al. | 343/897 |
| 5,488,383 | A * | 1/1996 | Friedman et al. | 343/912 |
| 5,686,930 | A * | 11/1997 | Brydon | 343/912 |
| 5,959,595 | A * | 9/1999 | Witschen et al. | 343/912 |
| 6,917,347 | B2 * | 7/2005 | Long et al. | 343/912 |
| 2004/0113863 | A1 * | 6/2004 | Stonier | 343/897 |
| 2012/0268344 | A1 * | 10/2012 | McCarthy | 343/893 |
| 2015/0009085 | A1 * | 1/2015 | Lawrence | 343/840 |

* cited by examiner

*Primary Examiner* — Trinh Dinh
(74) *Attorney, Agent, or Firm* — US Naval Research Laboratory; Sally A. Ferrett

(57) ABSTRACT

A passive intermodulation modulation reducing structure for a multicarrier reflector system, including a plurality of flexible reflector gores, each gore having a thin layer of conductive metal, a first layer of dielectric material laminated to one face of the conductive metal, and a second layer of dielectric material laminated to an opposite face of the conductive metal. Capacitive coupling joins the reflector's RF components. The structure can be a deployable parabolic reflector for a satellite antenna.

12 Claims, 8 Drawing Sheets

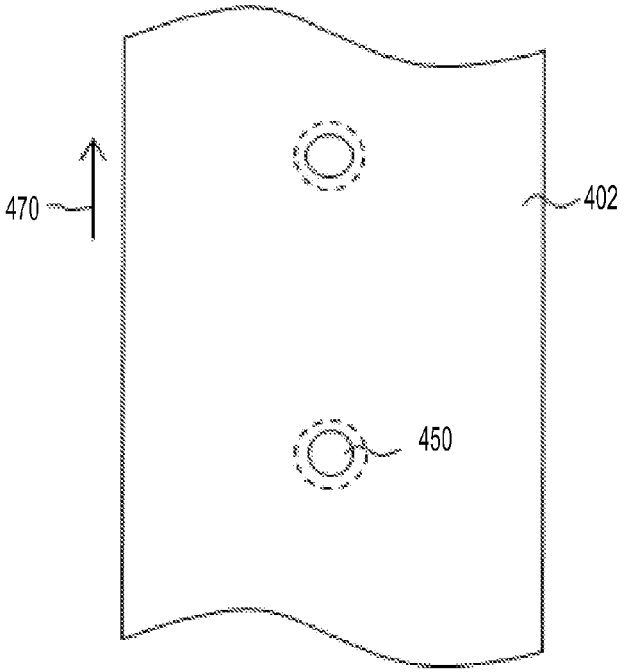
FIG. 4B
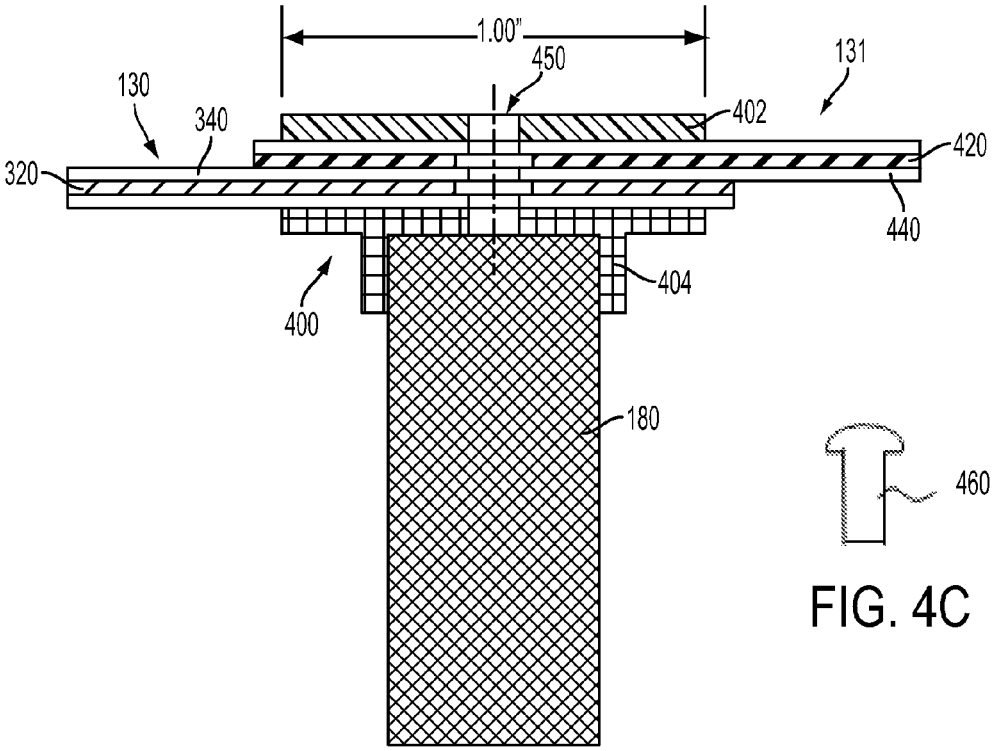
FIG. 4C
FIG. 4A

DEPLOYABLE SATELLITE REFLECTOR WITH A LOW PASSIVE INTERMODULATION DESIGN

CROSS-REFERENCE TO RELATED APPLICATIONS

This Application is a continuation of application Ser. No. 13/528,810, filed on Jun. 20, 2012, which is a continuation of Ser. No. 13/301,292, filed on Nov. 11, 2011, which is a continuation-in-part of application Ser. No. 13/102,848 filed on May 6, 2011. Application Ser. No. 13/102,848 is a non-provisional under 35 USC 119(e) of, and claims the benefit of, U.S. Provisional Application 61/331,878 filed on May 6, 2010. The entire disclosure of each of these documents is incorporated by reference herein.

BACKGROUND OF THE INVENTION

1. Technical Field

This is related to RF reflector devices, and more particularly, to satellite reflectors.

2. Related Technologies

Fleet Satellite Communications System satellites, which were launched in the years between 1979 and 1980, have provided UHF communications to the U.S. Navy. The UHF Follow-on System (UFO) constellation of satellites replaced the FLTSATCOM satellites, providing UHF capability to the US Navy, as discussed in D. H. Martin, A History of U.S. Military Satellite Communication Systems, Crosslink, Space Communications, The Aerospace Corporation, Vol. 3, No. 1 (Winter 2001/2002).

Since the 1970s, deployable antennas have been developed that can be stowed within the launch vehicle, and that can be unfurled or unfolded to a deployed configuration, providing a larger aperture for the reflector. One example is ATS-6, with a 30-ft diameter mesh reflector, discussed in J. P. Corrigan, "AT-6 Experimental Summary", IEEE Trans Aerospace and Electronic Systems, vol. AES-11, pp. 1004-1031 (November 1975). Another deployable antenna is described in M. W. Thomson, "The Astromesh Deployable Reflector", 1999 IEEE AP-S Symposium Digest, (June 1999) Orlando Fla., and in U.S. Pat. No. 5,680,145 "Light-weight Reflector for Concentrating Radiation" to Thomson et al. Deployable reflectors are also disclosed in U.S. Pat. No. 7,389,353" Deployable Mesh Reflector" to Bassily et al. and in U.S. Pat. No. 7,009,578 "Deployable Antenna with Foldable Resilient Members" to Nolan et al.

For multicarrier communications satellite reflectors, passive intermodulation has been a concern. Passive intermodulation issues are described generally in Boyhan, J. W., Lenzing, H. F., and Koduru, C., "Satellite Passive Inermodulation: Systems Considerations", IEEE Trans Aerospace and Electronic Systems", vol. 32, pp. 1058-1063, July 1996 and in Boyhan, J. W. , "Ratio of Gaussian PIM to two-carrier PIM," IEEE Trans Aerospace and Electronic Systems, vol. 36, no. 4, pp. 1336-1342, October 2000. Contributions to passive intermodulation by particular system components are described in Henrie, J., Christianson, A., and Chappell, W. J., "Prediction of passive intermodulation from coaxial connectors in microwave networks", IEEE Trans Microwave Theory and Techniques, Vol. 56, No. 1, January 2008, in Henrie, J. J., Christianson, A. J., Chappell, W. J., "Linear-Nonlinear Interaction and Passive Intermodulation Distortion," IEEE Trans Microwave Theory and Techniques, vol. 58, no. 5, pp. 1230-1237, May 2010, in Vicente, C. and Hartnagel, H. L., "Passive-Intermodulation Analysis Between Rough Rectangular Waveguide Flanges," IEEE Trans Microwave Theory and Techniques, vol. 53, no. 8, pp. 2515-2525, August 2005, Vicente, C., Hartnagel, H. L., Gimeno, B., Boria, V., and Raboso, D., "Experimental Analysis of Passive Intermodulation at Waveguide Flange Bolted Connections," IEEE Trans Microwave Theory and Techniques, vol. 55, no. 5, pp. 1018-1028, May 2007, and Apsden, P. L. and Anderson, A. P., "Identification of passive intermodulation product generation on microwave reflecting surfaces", IEEE Proc Microwaves, Antennas and Propagation, Vol. 139, No. 4, pp. 337-342, August 1992.

Deployable reflectors for satellite applications often use a woven wire mesh as the reflective surface. In order to reduce PIM generation, this mesh is typically stretched much tighter than would otherwise be required, while still maintaining the proper reflector shape. The tension must be maintained over a very wide range of temperatures for several years without significant breakage or other changes in shape. The fabrication and assembly of each reflector can be a very painstaking process that typically requires a large, specialized facility and many experienced people.

BRIEF SUMMARY OF THE INVENTION

A passive intermodulation modulation reducing structure for a multicarrier reflector system, comprising a plurality of flexible reflector gores, each gore having a thin layer of conductive metal, a first layer of dielectric material laminated to one face of the conductive metal, and a second layer of dielectric material laminated to an opposite face of the conductive metal. The conductive layer can be patterned, a grid, or continuous. The conductive layer can be copper and the first layer and the second layers of dielectric can be polyimide film.

Each gore side portions can have wide strips of continuous conductive metal. The reflector can have a plurality of ribs, each rib attached to the edge portions of two adjacent reflector gores, the gores being attached to the ribs with nonmetallic mechanical fasteners, the nonmetallic fasteners preferably being plastic, and more preferably being an extruded glass reinforced polyetherimide. Each gore can also include thermal and/or static coatings, such as a first layer of germanium deposited on the outer face of the first layer of dielectric material, and a second layer of germanium deposited on the outer face of the second layer of dielectric material. The flexible antenna reflector gore can be a continuous sheet with no joints or seams.

The structure can be a parabolic reflector in a satellite antenna, for example, capable of transmitting and receiving multiple carriers simultaneously over a frequency range of 240 MHz to 420 MHz.

The structure can also include a metallic central tube centrally arranged capacitively coupled to a fixed reflector surface.

An aspect of the invention is directed to a low passive intermodulation modulation antenna structure having a flexible parabolic antenna reflector with capacitively coupled RF joints between adjacent reflector gores. The individual reflector gores are connected together to form a continuous reflective surface through capacitive coupling. The coupling is accomplished by overlapping adjacent gores so a dielectric material between the conductive layers of the overlapping gores forms a capacitor, allowing RF currents to flow from one gore to another with very little disturbance.

BRIEF DESCRIPTION OF THE DRAWINGS

FIG. 1C is a cross sectional view of the antenna.

FIGS. 4A and 4B illustrate a low-PIM capacitively coupled joint between two adjacent reflector gores, and FIG. 4C illustrates a non-conductive connector for the capacitively coupled joint.

DETAILED DESCRIPTION OF THE INVENTION

Figure 1A:
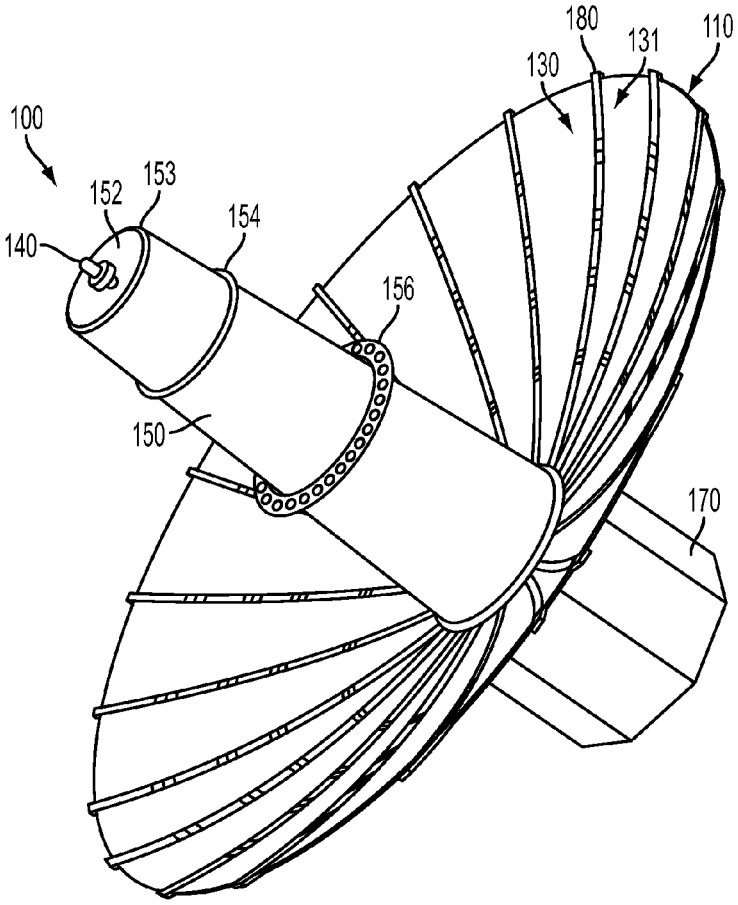
FIG. 1A illustrates an exemplary satellite antenna with a parabolic reflector surface in a deployed configuration for orbit about the earth.
Figure 1B:
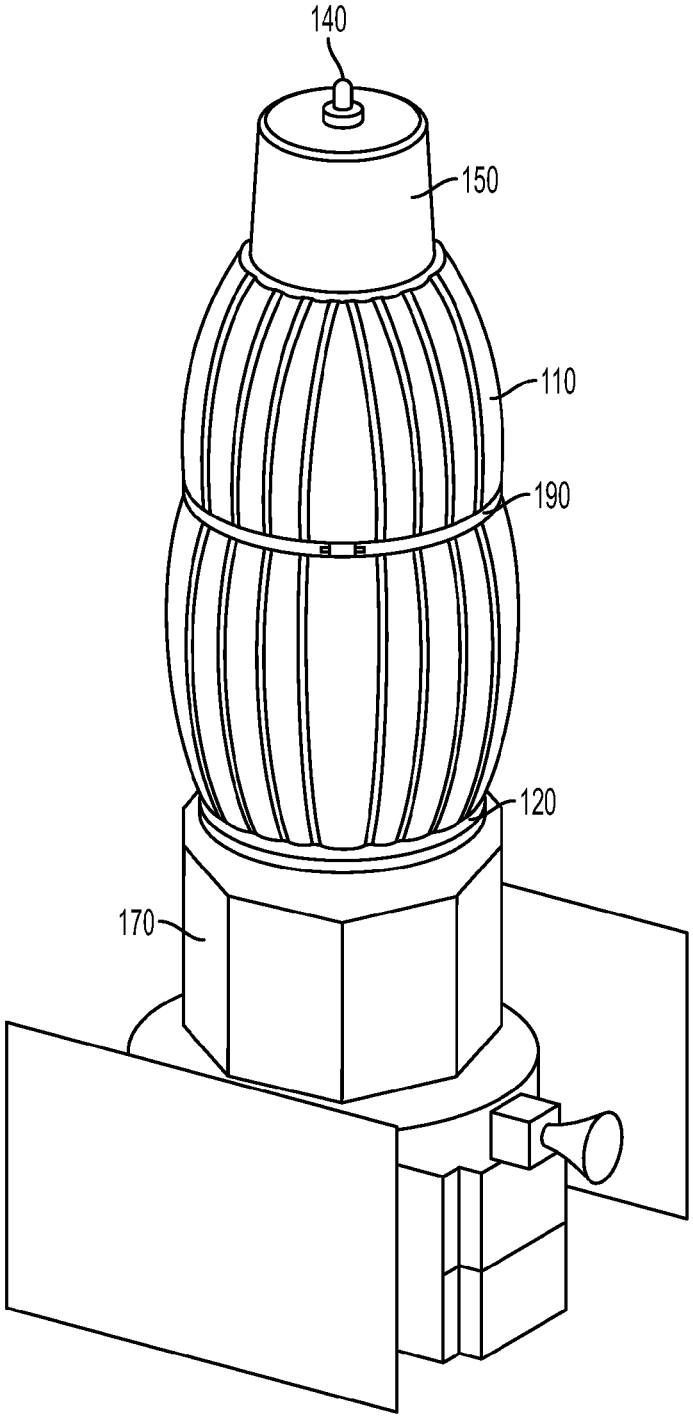
FIG. 1B is a view of the antenna in a stowed configuration.

FIG. 1A illustrates an exemplary satellite antenna 100 with a parabolic reflector surface in a deployed configuration for orbit about the earth. FIG. 1B is a view of the antenna in a stowed configuration, and FIG. 1C is a cross sectional view of the antenna.

Passive intermodulation (PIM) products are generated when two or more signals are applied to a non-linear circuit or material. PIM is a particular problem in multi-carrier systems in which transmit and receive functions share components, e.g., antennas, diplexers, and others.

The exemplary antenna reflector system described herein is designed and built to minimize passive intermodulation by avoiding ferromagnetic materials, minimizing metal-to-metal interfaces, avoiding dissimilar metal contacts, shielding materials and joints from RF energy, using electromagnetic coupling techniques, employing high contact pressures, using clean, smooth, corrosion-free surfaces, and minimizing the number of parts. These PIM-reflecting techniques are implemented in the reflector surface and gore seams, the coax connection to the UHF feed, the central tube interface at the reflector surface, and in the fixed/deployed reflective surface interface and hinge system.

The antenna 100 includes a parabolic deployable reflector 110 and a feed support cone 150, which is a truncated conical RF-compatible support structure, and a UHF feed. In a preferred embodiment, the deployable reflector 110 includes number of lightweight, flexible reflector gores 130 fastened at the edges to rib structures. The reflector material and the connections between reflector gores and other antenna components provide a passive-intermodulation system suitable for a wide UHF frequency range, as will be discussed in later paragraphs in more detail. The low PIM design allows the reflector to be carry both high and low frequencies, without interference.

The reflector disclosed herein is intended to carry UHF signals in the range of 240-420 MHz. The parabolic reflector has a f/D of 0.425. The relatively low frequency range allows the reflector surface accuracy to be designed such that the root mean square (RMS) deviation of the surface can be up to 6.35 mm (0.25 inch) from an ideal parabola profile. This RMS deviation, while being very loose compared to many industry standard reflectors, meets the requirements of the UHF communication application. Reflectors for other frequency bands can be built, which incorporate the capacitive coupling design and other features of this reflector.

Twenty ribs 180 support the flexible reflector surface 130, and are hingedly attached to hinge points located circumferentially around the exterior surface of an antenna-payload interface ring 120. The antenna-payload interface ring 120 also connects the antenna 100 to the satellite payload 170.

The feed support cone 150 is preferably formed of a strong, lightweight material. In this example, the feed support cone is a S2 fiberglass with a 8/1 satin weave, and has a height of about seven feet. The fiberglass feed support cone structure is laid up with several plys, with the number of plys greater toward the base of the cone. For a nominal ply thickness of 0.005 inches, it can be suitable to have 11 plies at the base, and seven plys at the top. A mid-span support ring 156, a top rib support ring 154, and a closeout ring, positioned at the outer surface of the feed support cone 150 support the reflector in its stowed configuration. The closeout ring 153 attaches the top plate 152 and the feed horn to the feed support cone 150.

A strap mechanism 190 keeps the reflector gore in its stowed position until deployment, with a frangibolt positioned to free the strap mechanism for deployment of the reflector. The system further includes a kickoff spring at the top far end of each of the ribs, to initiate deployment of the parabolic reflector. The kickoff springs are compressed when the parabolic reflector is in its stowed configuration. The ribs 180 are hingedly attached to the antenna-payload interface ring 120. A spring cartridge is positioned at the hinge point at each of the ribs. The rib 180 can be formed of a strong, lightweight, rigid, non-conductive, non-metallic material, for example, Ultem 2300 extruded glass reinforced polyetherimide. It is noted that the Ultem 2300 is a preferred material, as it has been found to get stronger when exposed to radiation encountered in space applications.

The antenna can also include a space ground link system (SGLS) antenna 140, positioned at the top plate 152, and other communications devices, such as X-band horns and mounts (not shown). One or more reflector gore can have cut-outs (not shown) positioned to allow the X-band horn or other communications devices to extend through the reflector.

Figure 2A:
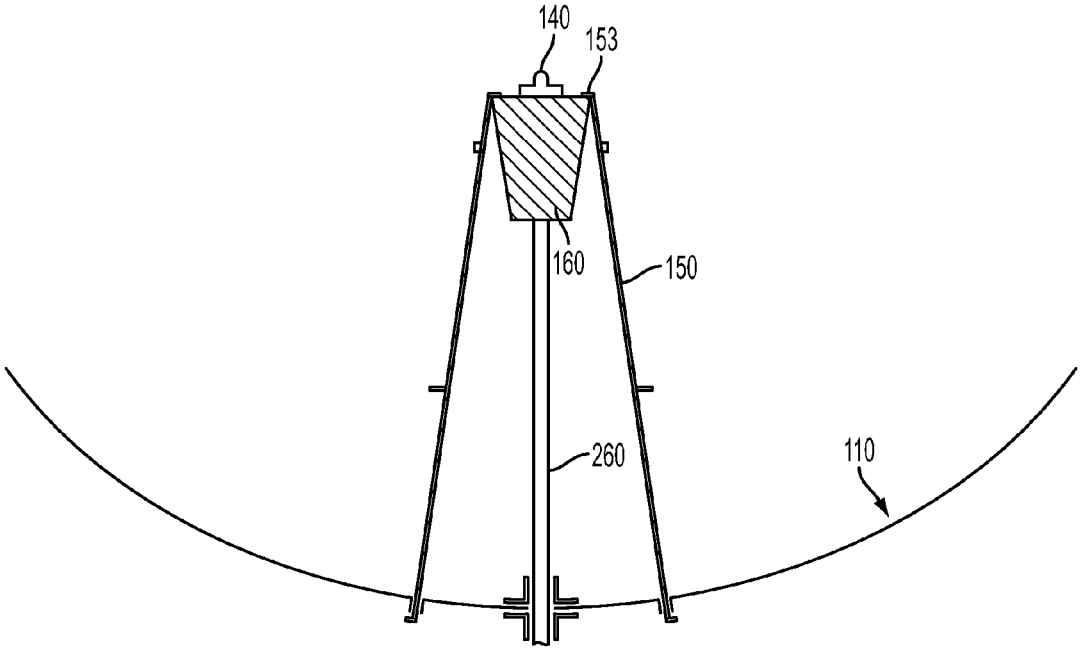
FIG. 2A is a cross sectional view of the feed support cone and reflector base of the antenna of FIGS. 1A and 1B.

As seen in FIG. 2A, a central coaxial tube 260 houses several coaxial cables (not shown) that connect the payload electronics to the spiral conical UHF feed horn 160 and the SLGS antenna 140. The coaxial tube 260 also provides structural support to the UHF feed. The coaxial tube 260 is preferably formed of aluminum, or another sufficiently strong, lightweight material, coated with a polyimide film such as that manufactured by E. I. du Pont de Nemours and Company under the tradename KAPTON®. In this embodiment, the feed tube 260 and the feed horn 160 together have a height of about seven feet.

Figure 2B:
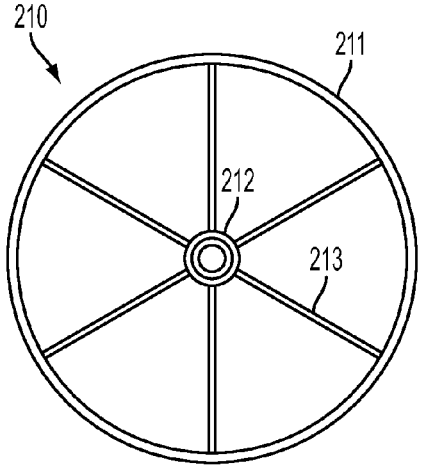
FIG. 2B illustrates the reflector base in more detail.

The base ring 210, shown in FIG. 2B, includes a central annular portion 212 and an outer annular portion 211 joined together with several spokes 213. The central annular portion is sized to surround the coaxial tube 260 and the outer annular portion is sized to support the wide lower end of the feed support cone 150. The base ring 210 is preferably formed of a lightweight, strong, rigid dielectric such as an extruded glass reinforced polyetherimide (PEI), e.g., ULTEM 2300 (ULTEM is a registered trademark of General Electric Company).

In a preferred embodiment, the deployable portion of the reflector includes number of lightweight, flexible reflector gores fastened at the edges to rib structures. A reflector gore 130 is illustrated in FIG. 3A, and the reflector material is shown in more detail in FIGS. 3B, 3C, and 3D.

The reflector gore's material is copper or another conductive metal layer 302 sandwiched between thin dielectric sheets 304 and 306 that are laminated onto the metal layer. In a preferred embodiment, the thin dielectric sheets are a polyimide film such as KAPTON®. The polyimide-copper-polyimide sandwich provides a flexible, RF-reflective surface.

The copper layer is typically made as thin as possible to minimize mass and maximize flexibility while still providing sufficient RF reflectivity. Patterning of the copper layer is not required, but helps to make the gores more flexible as well as further reducing overall mass.

Figure 3A:
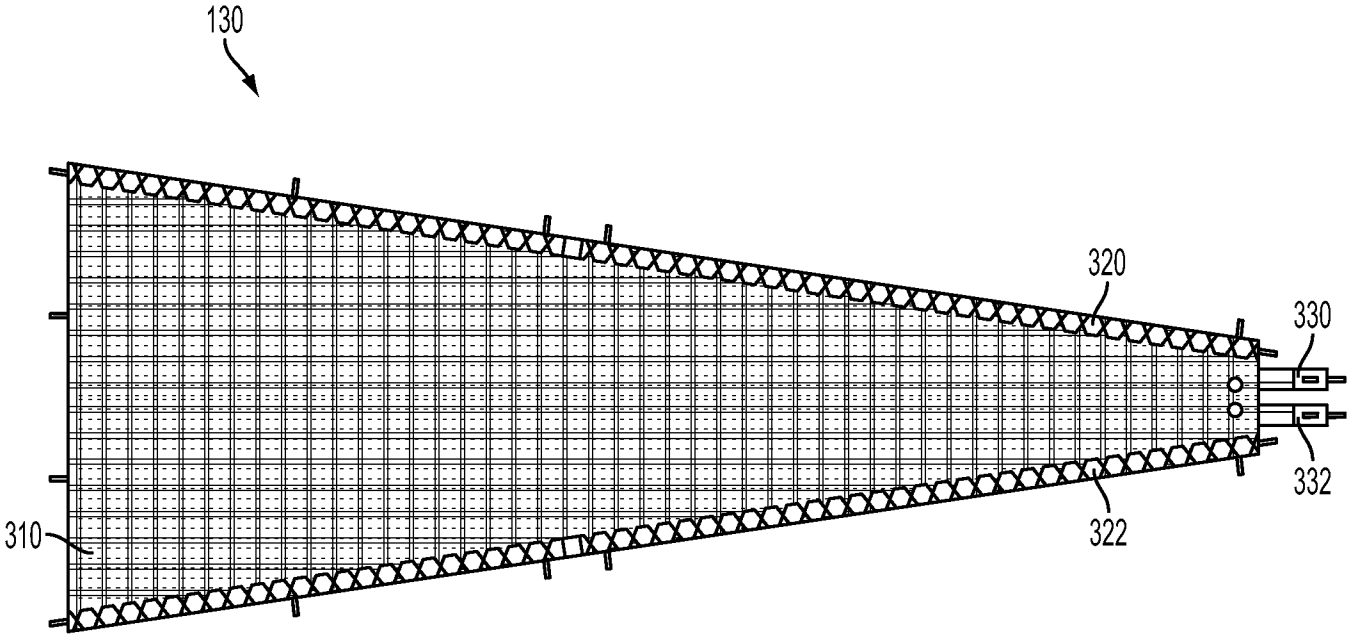
FIGS. 3A, 3B, 3C, and 3D are views of the reflector gore material.

As seen in FIG. 3A, the reflector gore's conductive grid 310 extends over the central portion of each gore, with a wide copper strip 320 and 322 at each edge. The wide copper strips 221 and 222 along each edge of the gore provide additional strength and good capacitive coupling with the adjacent gores and other electrical conductors, as discussed further in later paragraphs. Copper tabs 330, 332 along the inner edge of the reflector gore 130 can provide a conductive surface for capacitive coupling to an adjacent fixed reflector in the central region of the parabolic reflector.

Figure 3B:
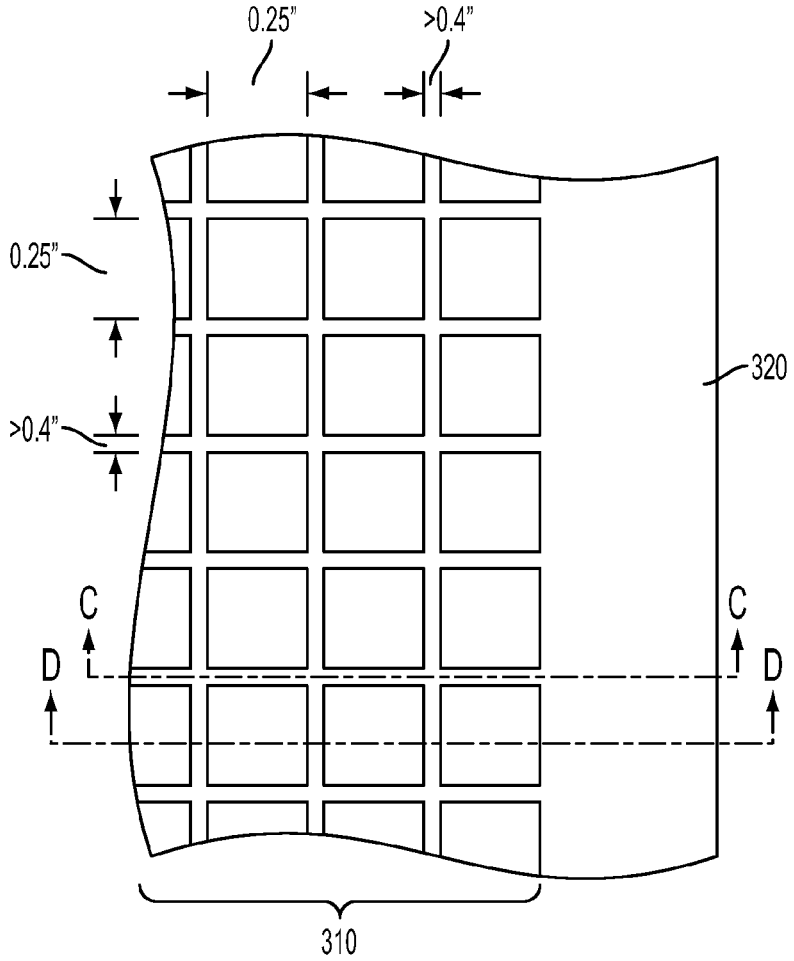
Figure 3C:
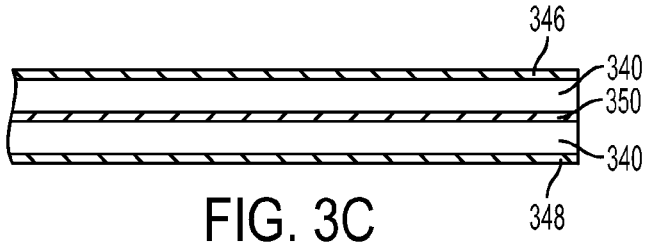
Figure 3D:
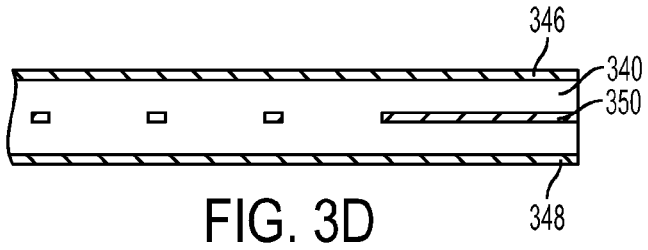

FIG. 3B illustrates the conductive grid 310 of the copper layer 302 having a rectangular grid pattern, with the rectangular grid strip portions spaced apart approximately ¼ inch on center, and at least approximately 0.04 inches in width. The grid can be designed with different spacing and strip width depending on the expected frequency of operation for the reflector. Other grid shapes and spacings are also suitable.

The laminated polyimide film layers 340 support and protect the copper layer 350, minimize snagging of the patterned copper grid, and help control the radius of any flexure, thus preventing creasing or over-bending of the reflector gore. The polyimide films 340 also provide surfaces upon which to deposit thermal and anti-charging treatments. The thermal treatments can reduce temperature extremes, and the anti-charging treatments can minimize charge build-up on the reflector surface. As one example, the outer surfaces of the polyimide films in FIGS. 2A, 2B, and 2C are sputtered with Germanium. The Germanium layers 346 and 348 can minimize the static charge buildup on the material.

The copper layer 350 is preferably at least three skin depths in thickness. In this example, the copper is approximately 0.7 mils (0.0007 inches), with three skin depths being 0.55 mils at a frequency of 200 MHz.

In this example, the reflector gore has a length of approximately 65 inches, and a width at its outer edge of approximately 24 inches, although the manufacturing and interface techniques also encompass smaller or larger reflector sheets.

It is noted that other materials can be used as the conductive layer in the reflector, however, copper has good electrical conductivity and is less likely to generate passive intermodulation than metals such as steel or aluminum. Other low-PIM metals that may be suitable for use as the reflector's metal layer include gold and silver. Non-metal conductors are also suitable.

To minimize PIM, each gore is preferably formed as a single continuous sheet, one without any breaks or joints in the copper layer 350 or the dielectric layers.

Although only one metallic grid is shown in FIG. 3A-3D, the reflector material can include additional conductive layers. For example, a reflector might include more than one metallic layer, each configured with different thicknesses and grid spacings to operate at a different frequency range. Preferably, each conductive layer will be separated by a dielectric to prevent direct metal-to-metal contact.

The individual reflector gores are connected together to form a continuous reflective surface through capacitive coupling. This coupling is accomplished by overlapping the gores in a way that uses the polyimide film between the conductive layers of the two gores to create a capacitor. The film layers also prohibit metal-to-metal contact between the gores to prevent PIM generation. The materials and dimensions in the overlap area are chosen to ensure that the capacitor has a very low series impedance in the frequency range of operation, effectively making the joint disappear and allowing the RF currents to flow from one gore to the next with very little disturbance.

This same technique is used in place of the metallic interface every place a metallic interface would typically be used to create an RF-continuous joint or junction to prevent the metal-to-metal contact that creates PIM.

As one example, FIGS. 4A and 4B illustrate the intersection of two adjacent reflector gores 130 and 131 at a support rib 180. The components of a connector 400 include a top cap 402 and edge cap 404, which are both formed of a non-conductive non-metallic material such as a plastic such as extruded glass reinforced polyetherimide such as Ultem 2300.

The wide copper strips of each of the gores 130 and 131 overlap and are held in place against the rib 180 by a series of connector 460 extending along the length of the rib. Each connector 460 is formed of a non-conductive material such as Ultem 2300.

As seen in FIG. 4A, the wide copper strips 320 and 420 are separated by one or more layers 340, 440 of the polyimide dielectric film so there is no direct metal to metal contact between the copper layers. The copper layers and the dielectric film form a capacitor for capacitively coupling the adjacent reflector gores 130 and 131. In this example, the width of overlap of the copper layers of the adjacent gores is approximately equal to the width of the of the top cap, edge cap, and rib, e.g., about one inch. The amount of overlap can be varied to provide additional strength or capacitive coupling ability, depending on the application. In this example, a number of connectors 460 are spaced apart along the lengthwise direction 470 of each of the ribs. The edge cap 404 and top cap 402 have a curvature that fits the concave curvature of the rib 180.

The edge cap and top cap can also be press fit together, adhesively joined, attached with a snap fitting, or screwed together, with all materials being dielectric to prevent metal to metal contact between the conductive metal layers of the gores.

Figure 5A:
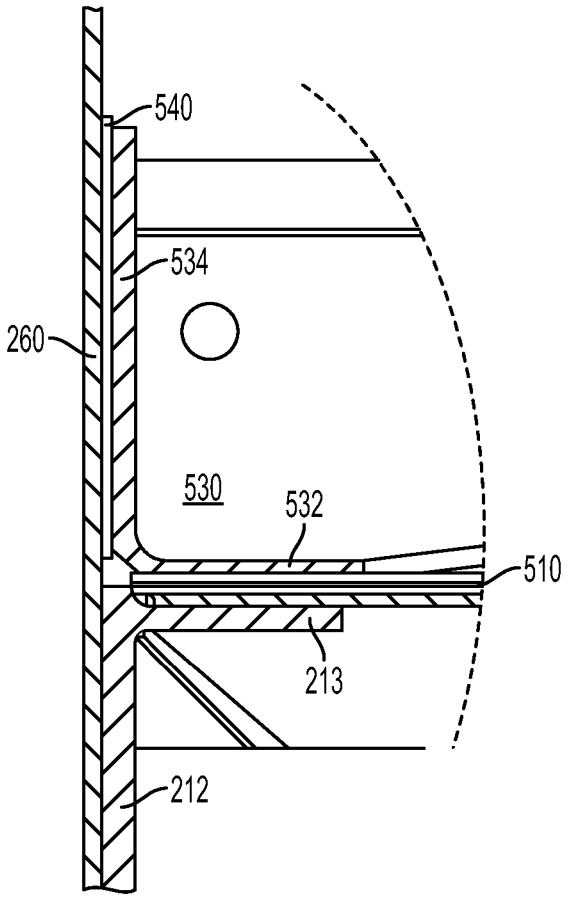
FIGS. 5A and 5B illustrate a low-PIM capacitively coupled joint between a central tube and a reflector.

FIG. 5A is a cross sectional view of a portion of the exterior surface of the central coaxial tube 260 and a fixed reflector surface 510. The fixed reflector surface is arranged centrally inside the outer reflector gores 180 in the region approximately under the support cone 150. The central coaxial tube 260 is capacitively coupled to the copper layer of the reflector surface 510, without any metal-to-metal connection between the central tube 260 and the reflector. The central tube and reflector base are effectively hidden from RF energy.

Figure 5B:
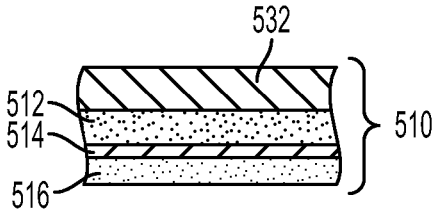

As seen in FIG. 5A, a metallic ring clamp 530 has an annular portion 534 that surrounds the central tube 260 and a flange portion 532 that extends outwardly from the annular portion of the ring clamp. A dielectric polyimide sheet 540 is arranged between the inner surface of the annular portion 534 of the metallic ring clamp and the aluminum central tube 260 to prevent metal-to-metal contact between the ring clamp and the aluminum central tube. The aluminum central tube 260, the dielectric sheet 540, and the annular portion of the ring clamp 534 form a capacitor, capacitively coupling high frequency signals from the central tube to the ring clamp. As seen in FIG. 5B, the polyimide layer 514 of the fixed reflector 510 separates the reflector gore's copper layer 514 from the metallic ring clamp 532, preventing metal to metal contact between the copper layer and the ring clamp, but forming a capacitive coupling between the metallic ring clamp and the gridded copper layer of the reflector 510. In this way, high frequency signals from the UHF feed horn are coupled from the outer surface of the coaxial tube 260 to the central portion of the parabolic reflector.

Figure 6:
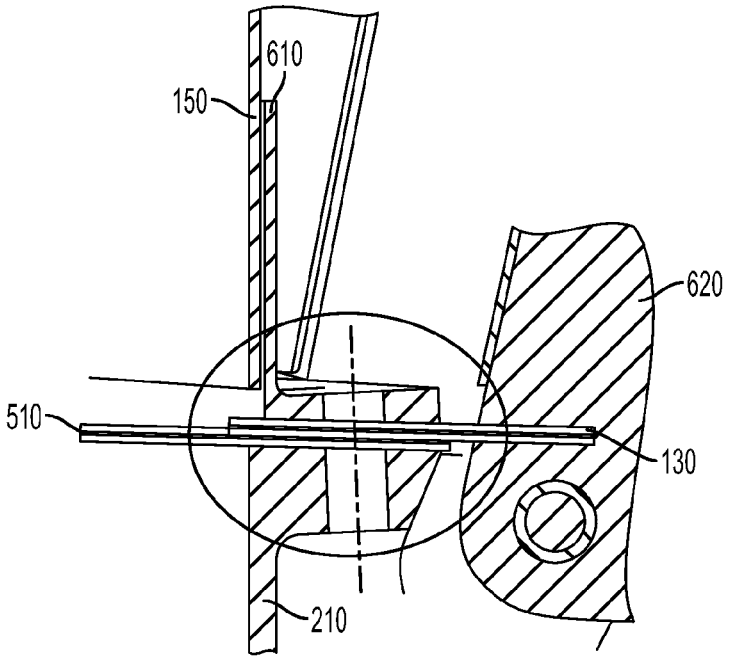
FIG. 6 illustrates a low-PIM capacitively coupled joint between a base ring and a reflector gore.

FIG. 6 illustrates a connection between the central reflector material and the outer reflector gore at the fiberglass feed support cone 150. The fixed reflector 510 is capacitively coupled to the reflector gore 130, without any direct metal-to-metal contact. Wide copper strips or tabs on the outer edge of the fixed reflector allow overlap with the wide copper strips or tabs 330, 332 of the reflector gore 130 shown in FIG. 3A.

As shown in FIG. 6A, an aluminum mounting ring 610 for the feed support cone 150 is separated from the outer ring portion of the base ring 210. The fixed reflector surface 510 and the movable reflector gore 130 are clamped together between the aluminum mounting ring and the reflector base. The ribs 180 that support the movable reflector gores 130 are hinged to the base ring 210. The dielectric layers of the fixed reflector 510 and the movable reflector gore 130 prevents metal-to-metal contact and allows capacitive coupling between the fixed reflector and the movable reflector gores. In this way, the signal from the feed horn is capacitively transmitted from the coaxial tube 260 to the fixed reflector 510 and then to the reflector gores 130, while minimizing passive intermodulation and minimizing RF transmission to the payload region of the satellite.

The reflector system described above is inherently low-PIM, as a result of the reflector surface being made from a very thin, continuous sheet of copper, which is a very linear material, with no metal-to-metal joints or junctions to generate PIM.

The plastic layers that support the copper reflective layer also provide several benefits. First, the dielectric layer of the distributed capacitors couple all the metallic pieces together at RF frequencies while maintaining physical separation, thus minimizing PIM. The plastic layers further provide a convenient method of managing the behavior of the reflective surface during deployment to eliminate the possibility of tangling or snagging, and the plastic surfaces are available to carry various thermal coatings that reduce the temperature variation of the reflector, and to carry various coatings that equalize the charge collected on the surface and drain it away properly.

In addition, the reflector gores are mass producible. The reflector surface is made of many identical gores that are fabricated from flex-circuit-type materials and can be formed using techniques currently used to mass-produce the flex-circuits used in laptop computers, robotic arms, and many other devices.

The reflector is easy to assemble, compared to other current reflector designs. Careful design allows all the parts to incorporate all the necessary details, and enables fixturing to hold all the parts, leaving little to chance during assembly. Assembly is a relatively simple matter of laying ribs onto fixtures, the gores onto the ribs, and then installing fasteners, and requires only minimal training of standard assembly technicians.

The reflector described herein is relatively inexpensive to build. Component and parts reuse is inherent in the underlying design, allowing fewer parts to be made in larger numbers for lower per-part costs. Ease of assembly also reduces labor costs.

Although copper is shown as the conductive material layer in the reflector surface, any conductive material, including non-metallics, can be used as the conductor. The layer's thickness can be varied, and the conductor surface can be gridded or continuous. Patterning of the layers can be any shape suitable for the application.

Although polyimide is used as an example of a suitable dielectric layer, various flexible dielectric materials can be used as the dielectric layer in the reflector. Thickness can be varied to meet strength and capacitance requirements of a particular application. Thermal and charging coatings can be whatever is appropriate for the application.

The capacitive coupling geometry can be whatever is necessary to suite the frequency range of operation and geometric situation.

The reflector surface is not restricted to the circular paraboloid described above. For example, the reflector surface can be planar, square, rectangular, or a different shape. The reflector can be used in applications other than as in a parabolic antenna reflector.

The reflector described herein has a deployable surface with movable gores, however, the invention also encompasses stationary reflectors and devices having low-PIM interfaces as described herein.

The reflector can be used in land-based and sea-based applications in addition to the space-based satellite application described herein.

Although this invention has been described in relation to several exemplary embodiments thereof, it is well understood by those skilled in the art that other variations and modifications can be affected on the preferred embodiments without departing from scope and spirit of the invention as set forth in the claims.

What is claimed as new and desired to be protected by Letters Patent of the United States is:

1. A passive intermodulation modulation reducing structure for a multicarrier reflector system, comprising:

a plurality of flexible reflector gores, each gore having a thin layer of conductive metal, a first layer of dielectric material laminated to one face of the conductive metal, and a second layer of dielectric material laminated to an opposite face of the conductive metal.

2. The structure of claim 1, wherein the conductive layer is a grid.

3. The structure of claim 1, wherein the conductive layer is copper and the first layer and the second layers of dielectric are polyimide.

4. The structure of claim 1, wherein each gore has side portions with wide strips of continuous conductive metal.

5. The structure of claim 1, further comprising:

a plurality of ribs, each rib attached to the edge portions of two adjacent reflector gores, the gores being attached to the ribs with nonmetallic mechanical fasteners, the nonmetallic fasteners preferably being plastic, and more preferably being an extruded glass reinforced polyetherimide.

6. The structure of claim 1, each gore further comprises:

a first layer of germanium deposited on the outer face of the first layer of dielectric material, and a second layer of germanium deposited on the outer face of the second layer of dielectric material.

7. The structure of claim 1, wherein the flexible antenna reflector gore is a continuous sheet with no joints or seams.

8. The structure of claim 1, further comprising:

a thermal coating to reduce the temperature variation across the gore.

9. The structure of claim 1, further comprising:

coatings to equalize the charge collected on the surface and drain it away from the reflector.

10. The structure of claim 1, wherein the structure is a parabolic reflector in a satellite antenna.

11. The structure of claim 1, wherein the antenna is a parabolic reflector capable of transmitting and receiving multiple carriers simultaneously over a frequency range of 240 MHz to 420 MHz.

12. The structure of claim 1, in combination with a metallic central tube centrally arranged capacitively coupled to a fixed reflector surface.

* * * * *